US005672457A

United States Patent [19]

Gibson et al.

[11] Patent Number: 5,672,457

[45] Date of Patent: Sep. 30, 1997

[54] LIQUID DEVELOPERS AND METHODS THEREOF

[75] Inventors: George A. Gibson, Fairport; Scott D. Chamberlain, Macedon, both of N.Y.

[73] Assignee: Xerox Corporation, Stamford, Conn.

[21] Appl. No.: 658,287

[22] Filed: Jun. 3, 1996

[51] Int. Cl.[6] ..... G03G 9/13; G03G 9/135

[52] U.S. Cl. ..... 430/115; 430/137

[58] Field of Search ..... 430/115, 137

[56] References Cited

U.S. PATENT DOCUMENTS

| | | | |
|---|---|---|---|
| 4,476,210 | 10/1984 | Craucher et al. | 430/114 |
| 4,760,009 | 7/1988 | Larson | 430/137 |
| 4,783,389 | 11/1988 | Larson | 430/137 |
| 4,923,778 | 5/1990 | Blair et al. | 430/137 |
| 5,017,451 | 5/1991 | Larson et al. | 430/137 |
| 5,019,477 | 5/1991 | Felder | 430/115 |
| 5,366,840 | 11/1994 | Larson et al. | 430/115 |
| 5,565,299 | 10/1996 | Gibson et al. | 430/137 |

*Primary Examiner*—Roland Martin
*Attorney, Agent, or Firm*—Annette L. Bade

[57] ABSTRACT

A mixed resin liquid developer and a process for the preparation of liquid developers comprised of a nonpolar liquid, a mixture of thermoplastic resin particles, a charge director, and a charge control agent, the process characterized by the addition of a first thermoplastic resin and a charge control agent, followed by adding to the product obtained a second thermoplastic resin.

30 Claims, No Drawings

LIQUID DEVELOPERS AND METHODS THEREOF

BACKGROUND OF THE INVENTION

The present invention relates to liquid developer compositions and methods for preparation of developer compositions and, in particular, to liquid developer compositions containing a mixture of resin, especially more than one resin, and particularly a mixture of two resins, and methods thereof. In embodiments, the present invention relates to methods for the preparation of liquid developers comprising a charge control agent and mixed resins.

The developers of the present invention can be selected for a number of known imaging and printing systems, such as xerographic processes, wherein latent images are rendered visible with the liquid developer illustrated herein. The image quality, solid area coverage and resolution for developed images usually require sufficient toner particle electrophoretic mobility. The mobility for effective image development is primarily dependent on the imaging system used. The electrophoretic mobility is primarily directly proportional to the charge on the toner particles and inversely proportional to the viscosity of the liquid developer fluid. A 10 to 30 percent change in fluid viscosity caused, for instance, by a 5° to 15° C. decrease in temperature could result in a decrease in image quality, poor image development and background development, for example, because of a 5 percent to 23 percent decrease in electrophoretic mobility.

Insufficient particle charge can also result in poor transfer of the toner to paper or other final substrates. Poor or unacceptable transfer can result in, for example, poor solid area coverage if insufficient toner is transferred to the final substrate and can also lead to image defects such as smears and hollowed fine features.

To overcome or minimize such problems, the liquid toners of the present invention were arrived at after extensive research efforts, and which toners result in, for example, sufficient particle charge for transfer and maintain the mobility within the desired range of the particular imaging system employed. Advantages associated with the present invention, include increasing the desired negative charge on the developer particles and, in embodiments, providing a liquid developer containing more than one resin and wherein the liquid toner possesses an almost completely negative charge. The superior charge can result in improved image development and superior image transfer.

A latent electrostatic image can be developed with toner particles dispersed in an insulating nonpolar liquid. The dispersed materials are known as liquid toners or liquid developers. A latent electrostatic image may be generated by providing a photoconductive layer with a uniform electrostatic charge, and subsequently discharging the electrostatic charge by exposing it to a modulated beam of radiant energy. Other methods are also known for forming latent electrostatic images such as, for example, providing a carrier with a dielectric surface and transferring a pre-formed electrostatic charge to the surface. After the latent image has been formed, it is developed by colored toner particles dispersed in a nonpolar liquid. The image may then be transferred to a receiver sheet or supporting substrate. Also known are ionographic imaging systems.

Useful liquid developers can comprise at least one thermoplastic resin and a dispersant nonpolar liquid. Generally, a suitable colorant, such as a dye or pigment, is also present. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 30 μm average by area size as measured using the Malvern 3600E particle sizer.

Since the formation of proper images depends, for example, on the difference of the charge between the toner particles in the liquid developer and the latent electrostatic image to be developed, it has been found desirable to add charge director compounds which increase the magnitude of the charge. Such charge director compounds include polyhydroxy compounds, amino alcohols, polybutylene succinimide compounds, aromatic hydrocarbons, metallic soaps, and the like to the liquid developer comprising the thermoplastic resin, the nonpolar liquid and the colorant.

U.S. Pat. No. 4,476,210 to Croucher et al., the disclosure of which is totally incorporated by reference herein in its entirety, discloses a method for making a stable colored liquid developer by preparing a graft or block copolymer amphipathic steric stabilizer, anchoring the stabilizer to a thermoplastic resin core, and to the aliphatic dispersion of the particles adding a solution of a dye dissolved in a polar solvent.

U.S. Pat. No. 4,760,009 to Larson, the disclosure of which is totally incorporated by reference herein in its entirety, discloses a process for the preparation of toner particles for electrostatic imaging comprising dispersing at an elevated temperature at least one thermoplastic resin, a nonpolar liquid, and optionally a colorant by means of moving particulate media, cooling the dispersion to permit precipitation of the resin out of the dispersant, and separating the dispersion of toner particles from the particulate media.

U.S. Pat. No. 4,783,389 to Trout et at., the disclosure of which is hereby incorporated by reference in its entirety, discloses a process for the preparation of toner particles for liquid electrostatic imaging comprising mixing a thermoplastic resin and a nonpolar liquid at a temperature sufficient to plasticize and liquefy the resin, cooling the mixture to form resin particles in the nonpolar liquid, and reducing the size of the resin particles to below 30 μm by passing the product through at least one liquid jet interaction chamber at a specific liquid pressure.

U.S. Pat. No. 4,923,778 to Blair et at., the disclosure of which is herein incorporated by reference in its entirety, discloses a process for preparation of toner particles for electrostatic liquid developers using a single vessel wherein a thermoplastic resin and hydrocarbon liquid are dispersed in the vessel by moving particulate media at elevated temperatures to plasticize and liquefy the resin, the dispersion is cooled whereby the resin precipitates in the form of toner particles having an average by area particles size of 10 gm or less, and the particulate media are then removed.

U.S. Pat. No. 5,017,451 to Larson et al., the disclosure of which is incorporated herein by reference in its entirety, discloses a continuous process for the preparation of a dispersion of liquid and resin or polymer particles having at least one additive dispersed in the resin which comprises introducing a blend of resin and at least one additive continuously into or blending the ingredients in an apparatus having means for melting the resin and dispersing the additive in the resin, melting the resin in the apparatus at an elevated temperature, moving continuously the blend of melted resin and additive through at least one mixing element, forming a dispersion by introducing into the molten blend a liquid, and introducing continuously the dispersion into a high shear cooling apparatus wherein the molten blend solidifies forming a stable dispersion of resin particles in the liquid.

U.S. Pat. No. 5,019,477 to Felder, the disclosure of which is hereby incorporated by reference in its entirety, discloses a liquid electrostatic developer comprising a nonpolar liquid, thermoplastic resin particles, and a charge director. The ionic or zwitterionic charge directors may include both negative charge directors such as lecithin, oil-soluble petroleum sulfonate and succinimide, and positive charge directors such as cobalt and iron naphthanates. The thermoplastic resin particles can comprise a mixture of (1) a polyethylene heteropolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene and (iv) selected from the group consisting of butadiene and acrylate. As the copolymer of polyethylene and methacrylic acid or methacrylic acid alkyl esters, NUCREL® (a copolymer of ethylene and methacrylic acid with a melt index at 190° C. of 500, available from E. I. DuPont de Nemours & Company, Wilmington, Del.) may be selected.

In U.S. Pat. No 5,366,840, the disclosure of which is herein incorporated by reference in its entirety, there is disclosed a liquid developer comprised of thermoplastic resin particles, an optional charge director, and a charge additive (also known as charge control agent and charge enhancing agent) comprised of aluminum-di-tertiary-butyl salicylate or ALOHAS. The disclosure of this reference is hereby incorporated by reference in its entirety.

In U.S. patent application Ser. No. 08/606,956, filed Feb. 23, 1996, pending (D/95450) assigned to the assignee of the present invention, the disclosure of which is herein incorporated by reference in its entirety, there is disclosed liquid developers comprised of a liquid, a resin, an optional charge director, and a charge enhancing agent (also known as charge additive and charge control agent) comprised of aluminum salts of acids, specifically, hydroxy carboxylic acids, amino carboxylic acids, aromatic sulfonic acids, aliphatic carboxylic acids, aromatic carboxylic acids, or mixtures thereof.

The disclosures of each of the U.S. patents just mentioned are incorporated herein by reference in their entirety.

It is advantageous to provide liquid developers with more than one resin. Use of a mixed resin may allow for the liquid developer to possess the benefits of the functionalities and the qualities of both resins. For example, some resins possess a high melt index while others have high toner charging. A liquid developer comprising a mixed resin such as that just described would possess both positive features of having high melt index and high toner charging. Other advantages include the ability to incorporate a resin with chemical binding abilities, such as methacrylic acid containing resins. These resins can be used to bind charge control agents, while still being compatible with other resins that give other functional properties, such as high melt index.

Generally, known processes for preparing liquid developers having more than one resin as used in a liquid developer composition comprise a two step process wherein all the individual components of the toner including the more than one resin and charge control agents are simultaneously mixed with heat (90° C.). The second step involves cooling the mixture at room temperature to solidify the dispersion, thereby forming the liquid developer. The first step is referred to as the hot melt step. This hot melt mixing is necessary for the charge control agents to become covalently bonded to the thermoplastic resin. The bonding occurs between the charge control agent and the acid groups on the thermoplastic resins. However, in the process just described, when the second resin is added simultaneously with the first resin, the reaction between the charge additive and the first resin can be incomplete. Therefore, insufficient bonding of the first thermoplastic resin to the charge control agent occurs and the charge control agent may dissolve into the continuous phase. In this continuous phase, the charge control agent interferes with charging, causing the normally negatively charged toners to contain some positively charged toner. These inferior electrical characteristics result in incomplete transfer of toner to copy substrate, insufficient image development, and image defects such as smearing, loss of resolution and loss of density. Unpredictable admix affects the final toner, thereby reducing toner life, causing agglomerations (leading to poor development and sump clogging), and causing insufficient pigment dispersion.

Therefore, there is a need for a process for providing liquid developers having more than one resin which allows sufficient bonding between the thermoplastic resin and the charge control agent to diminish the amount of charge control agent in the continuos phase, thereby increasing the percentage of negatively charged toner.

SUMMARY OF THE INVENTION

Examples of objects of the present invention include:

It is an object of the present invention to provide liquid developers and methods with many of the advantages indicated herein.

It is an object of the present invention to provide a liquid developer and a process for the preparation of negatively charged liquid developers.

Another object of the present invention is to provide a liquid developer and a process for the preparation of liquid developers capable of high particle charging.

It is another object of the invention to provide a liquid developer and a process for the preparation of liquid developers having a low viscosity of flow.

Another object of the present invention is to provide liquid developer and a process for the preparation of liquid developers which, in embodiments, maintain mobility within a desired range.

It is yet another object of the invention to provide a liquid developer and a process for the preparation of liquid developers having a small particle size.

Still another object of the present invention is to provide a liquid developer and a process of the preparation of liquid developers wherein the charge control agent and acid groups of the thermoplastic resin are completely bonded.

Another object of the present invention is to provide a liquid developer and a process for the preparation of liquid developers which result in improved image development and excellent image transfer.

Still another object of the present invention is to provide a liquid developer and a process for the preparation of liquid developers with a substantially high percentage, for example about 100%, of negatively charged toner.

It is still a further object of the invention to provide a liquid developer and a process for preparation of liquid developers wherein developed image defects such as smearing, loss of resolution and loss of density are eliminated, or minimized.

It is yet another object of the present invention to provide imaging processes for forming color images.

These and other objects of the present invention can be accomplished in embodiments by the provision of liquid developers with certain charge control agents and processes thereof. In embodiments, the present invention is directed to a process for the preparation of liquid developers comprised of a nonpolar liquid, a mixture of thermoplastic resin particles, a charge director, and charge control agents.

Embodiments include: a process for the preparation of liquid developers comprising a nonpolar liquid, a mixture of more than one thermoplastic resins, a charge director, and an aluminum charge control agent, wherein said process comprises melt mixing and reacting a first thermoplastic resin with said charge control agent, and subsequently adding to a product obtained a second thermoplastic resin.

Embodiments further include: a process for the preparation of liquid developers comprised of a nonpolar liquid, a mixture of thermoplastic resin particles, a charge director, and an aluminum charge control agent comprised of a component of the alternative formulas (a) or (b):

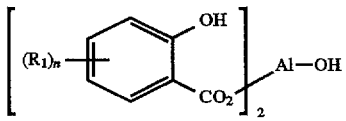

(a)

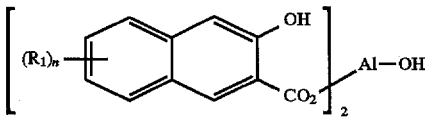

(b)

wherein $R_1$ is selected from the group consisting of hydrogen and alkyl, and n is a number 0 (zero), 1, 2, 3, or 4, wherein said process comprises melt mixing and reacting a first thermoplastic resin selected from the group consisting of a methacylic acid copolymer and an acrylic acid copolymer with said aluminum charge control agent, and subsequently adding to a product obtained an ethylene vinyl acetate as a second thermoplastic resin.

In addition, embodiments include: a process for the preparation of liquid developers comprised of a nonpolar liquid, a mixture of thermoplastic resin particles, a charge director, and an aluminum charge control agent selected from the group consisting of aluminum salts of hydroxy carboxylic acids, aluminum salts of amino carboxylic acids, aluminum salts of aromatic sulfonic acids, aluminum salts of aliphatic carboxylic acids, aluminum salts of aromatic carboxylic acids, and mixtures thereof, wherein said process comprises melt mixing and reacting a first thermoplastic resin selected from the group consisting of a methacylic acid copolymer and an acrylic acid copolymer with said aluminum charge control agent, and subsequently adding to a product obtained an ethylene vinyl acetate as a second thermoplastic resin.

DETAILED DESCRIPTION OF THE INVENTION

In embodiments, the present invention is directed to a process for the preparation of liquid developers comprising a nonpolar liquid, a mixture of thermoplastic resin particles, a charge director, and a charge control agent, wherein the process involves melt mixing and reacting a first thermoplastic resin with the charge control agent, and subsequently adding this product to a second thermoplastic resin.

Embodiments of the present invention also include a liquid developer comprised of two thermoplastic resins, a charge director, and charge control agents; a liquid developer comprised of a liquid component, two different thermoplastic resins, an ionic or zwitterionic charge director or directors soluble in a nonpolar liquid, and aluminum charge control agents; and a liquid electrostatographic developer comprised of (A) a liquid having viscosity of from about 0.5 to about 20 centipoise and resistivity equal to and preferably greater than $5\times10^9$, (13) particles with two different thermoplastic resins with an average volume particle diameter of from about 0.1 to about 10 microns, and preferably from about 1 to about 5 microns, (C) a nonpolar liquid soluble ionic or zwitterionic charge director compound, and (D) an aluminum complex·charge control agent, and wherein one resin is comprised of a methacrylic acid and the second resin is comprised of an ethylene vinyl acetate.

Examples of charge control agents selected for the developers of the present invention include charge control agents comprised of a component of the following formulas (a) and (b):

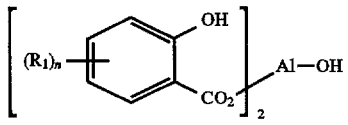

(a)

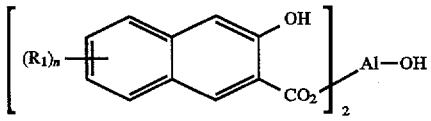

(b)

wherein $R_1$ is selected from the group consisting of hydrogen and alkyl, and n is a number 0 (zero), 1, 2, 3, or 4, wherein said process comprises melt mixing and reacting a first thermoplastic resin with the charge control agent, and subsequently adding to a product obtained a second thermoplastic resin.

Embodiments of the invention include a toner wherein $R_1$ is hydrogen, alkyl with from about 1 to about 25, and preferably 10 carbon atoms, like methyl, ethyl, propyl, or butyl; n is a number 0 (zero), 1, 2, 3, or 4; and wherein $R_1$ is preferably hydrogen, isopropyl, n-butyl, or tert-butyl. Charge control agents of the above formula are well known and referred to as ALOHAS. Examples thereof are set forth in U.S. Pat. No. 5,366,840 discussed in the background above. The aforementioned additives can be prepared as illustrated in U.S. Pat. No. 5,223,368, the disclosure of which is totally incorporated herein by reference.

Specific examples of ALOHAS charge control include aluminum di-tertiary-butyl salicylate; hydroxy bis[3,5-tertiary butyl salicylic]aluminate; hydroxy bis[3,5-tertiary butyl salicylic]aluminate mono-, di-, tri- or tetrahydrates; hydroxy bis[salicylic]aluminate; hydroxy bis[monoalkyl salicylic]aluminate; hydroxy bis[dialkyl salicylic]aluminate; hydroxy bis[trialkyl salicylic]aluminate; hydroxy bis [tetraalkyl salicylic]aluminate; hydroxy bis[hydroxy naphthoic acid]aluminate; hydroxy bis[monoalkylated hydroxy naphthoic acid]aluminate; bis[dialkylated hydroxy naphthoic acid]aluminate wherein alkyl preferably contains 1 to about 6 carbon atoms; bis[trialkylated hydroxy naphthoic acid]aluminate wherein alkyl preferably contains 1 to about 6 carbon atoms; bis[tetraalkylated hydroxy naphthoic acid] aluminate wherein alkali preferably contains 1 to about 6 carbon atoms; and the like.

Examples of other charge control agents useful in the present invention include charge control agents of aluminum salts of acids, specifically, hydroxy carboxylic acids, amino carboxylic acids, aromatic sulfonic acids, aliphatic carboxylic acids, aromatic carboxylic acids, or mixtures thereof. Specifically, these aluminum salts of acid charge control agents are of the formula $R_1R_2R_3Al$, wherein $R_1$ is OH; $R_2$ is selected from the group consisting of OH, hydroxy carboxylic acids, alpha or beta amino acids with primary, and secondary or tertiary amino groups; and $R_3$ is selected from the group consisting of hydroxy carboxylic acids, alpha or beta amino acids with primary, secondary or tertiary amino groups, and a compound of the following formula (a):

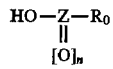

(a)

n = 1 or 2; Z = carbon or sulfur wherein, when Z is carbon, n is 1 and $R_0$ is selected from the group consisting of hydrogen, alkyl of from about 1 to about 20 carbons, alkenyl at from about 2 to about 20 carbons, cycloalkyl of from about 3 to about 7 carbons, aryl of from about 6 to about 18 carbons, alkylaryl of from about 7 to about 40 carbons, cycloalkylaryl of from about 8 to about 40 carbons and heteroaryl of from about 6 to about 18 carbons including heteroatoms of oxygen, nitrogen and sulfur, wherein $R_0$ may be substituted with alkoxy of from about 2 to about 20 carbons, carboalkoxy of from about 2 to about 20 carbons, alkoxy carbonyl having from about 2 to about 20 carbons, carboxamido, aldehydo, sulfonamido, nitro, cyano, and halogen groups, and when Z is sulfur, n is 2 and $R_0$ is selected from an aryl of about 6 to about 18 carbons, alkylaryl of from about 7 to about 40 carbons, cycloalkylaryl of from about 8 to about 40 carbons and heteroaryl of from about 6 to about 18 carbons including heteroatoms of oxygen, nitrogen and sulfur, and wherein $R_0$ may be substituted with alkoxy of from about 2 to about 20 carbons or carboalkoxy of from about 2 to about 20 carbons, with the provision that when $R_2$ is 3,5-di-t-butyl salicylic acid, $R_3$ is not a salicylic acid or an alkoxybenzoic acid.

In an embodiment of the invention, at least one of $R_2$ and $R_3$ of the aluminum salt of an acid charge control agent is a hydroxy aliphatic carboxylic acid. The aliphatic hydroxy carboxylic acids of the present invention preferably contain an alpha and beta aliphatic hydroxy carboxylic acid. Examples of aliphatic and aromatic hydroxy carboxylic acids include, but are not limited to a compound having the following general formula (b):

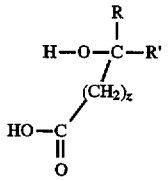

(b)

wherein R and R' are selected from the group consisting of hydrogen, alkyl of from about 1 to about 20 carbons, cycloalkyl of from about 3 to about 7 carbons, aryl of from about 6 to about 18 carbons, alkylaryl of from about 7 to about 40 carbons; wherein R or R' may be substituted with alkoxy of from about 2 to about 20 carbons, carboalkoxy of from about 2 to about 20 carbons, alkoxy carbonyl of from about 2 to about 20 carbons, carboxamido, aldehydo, sulfonamido, vitro, cyano, and halogen groups; and z is 0 or 1. Preferred are aliphatic alpha or beta hydroxy carboxylic acids and aromatic ortho hydroxy carboxylic acids. Specific examples of preferred aliphatic hydroxy carboxylic acids include 2-hydroxy butyric acid, 3-hydroxy butyric acid, 2-hydroxy valeric acid, and 2-hydroxy caproic acid. Examples of preferred aromatic hydroxy carboxylic acids include hydroxy 3,5-di-t-butyl salicylic acid, 3,5-diisopropyl salicylic acid, 3,5-diethyl salicylic acid, 3,5-dimethyl salicylic acid, 3,5-dichloro salicylic acid, 3,5-divitro salicylic acid, 2-hydroxy-1-biphenyl carboxylic acid, 2-hydroxy-1-naphthalene carboxylic acid, phenylglycolic acid, naphthylglycolic acid, 1-hydroxycyclohexane carboxylic acid, 2-hydroxycyclohexane carboxylic acid and 1-hydroxy-2-naphthalene carboxylic acid. Any monofunctional carboxylic acid can be used; yet, 3,5-di-t-butyl salicylic acid is preferred as one of $R_2$ and $R_3$, but not for both. However, when $R_2$ is 3,5-di-t-butyl salicylic acid, $R_3$ is not an alkoxybenzoic acid or a salicylic acid. It is preferred that when an aromatic hydroxy carboxylic acid group is present for at least one of $R_2$ and $R_3$, and when the aromatic hydroxy carboxylic acid has both the hydroxy group and the carboxylic acid group bonded to the aluminum atom, the compound must be an ortho-aromatic carboxylic acid so that both groups are in close proximity to the aluminum atom.

In embodiments, the aluminum salt of an acid charge control agent of the present invention may include sulfonic acids, aromatic carboxylic adds, or aliphatic carboxylic acids representative of $R_3$ in the formula $AlR_1R_2R_3$. Examples of sulfonic acids, aromatic carboxylic acids or aliphatic carboxylic acids include a compound of the following formula (a):

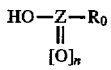

(a)

n = 1 or 2; Z = carbon or sulfur wherein, when Z is carbon, n is 1 and $R_0$ is selected from the group consisting of hydrogen, alkyl such as methyl 1 of from about 1 to about 20 carbons, alkenyl such as methylene of from about 2 to about 20 carbons, cycloalkyl such as cyclohexane of from about 3 to about 7 carbons, aryl such as phenyl of from about 6 to about 18 carbons, alkylaryl of from about 7 to about 40 carbons, cycloalkylaryl of from about 8 to about 40 carbons and heteroaryl of from about 4 to about 18 carbons including heteroatoms of oxygen, nitrogen and sulfur, wherein $R_0$ may be substituted with alkoxy of from about 2 to about 20 carbons, carboalkoxy of from about 2 to about 20 carbons, alkoxy carbonyl of from about 2 to about 20 carbons, carboxamido, aldehydo, sulfonamido, nitro, cyano, and halogen groups, and when Z is sulfur, n is 2 and $R_0$ is selected from the group consisting of an aryl of from about 6 to about 18 carbons, alkylaryl of from about 7 to about 40 carbons, cycloalkylaryl of from about 8 to about 40 carbons and heteroaryl of from about 4 to about 18 carbons including heteroatoms of oxygen, nitrogen and sulfur, and wherein $R_0$ may be substituted with alkoxy of from about 2 to about 20 carbons or carboalkoxy of from about 2 to about 20 carbons.

In another embodiment of the invention, at least one of $R_2$ and $R_3$ is an amino carboxylic acid, particularly an alpha or beta amino acid. It is particularly preferred that the amino carboxylic acid is an alpha or beta amino acid with primary, secondary or tertiary amino groups. Examples of alpha or beta amino acids with primary, secondary or tertiary amino groups useful in the present invention include a compound represented by the following two general formulas (c):

(c1) (c2)

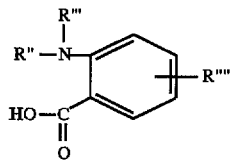

-continued

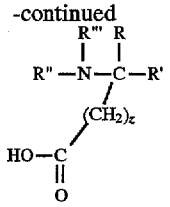

Beta Aromatic Amino-Aromatic Carboxylic Acid

Alpha or Beta Aliphatic or Aromatic Amino-Aliphatic Carboxylic Acid wherein z is 0 or 1, R, R', R" and R'" are selected from the group consisting of hydrogen, alkyl of from about 1 to about 20 carbons, cycloalkyl of from about 3 to about 7 carbons, aryl of from about 6 to about 18 carbons, alkylaryl of from about 7 to about 40 carbons; R"" is selected from alkyl of from about 1 to about 20 carbons, aryl of from about 4 to about 18 carbons, fused aromatic, fused cycloaliphatic, nitro, halogen, cyano, alkoxy of from about 2 to about 20 carbons, carboalkoxy of from about 2 to about 20 carbons, alkoxy carbonyl of from about 2 to about 20 carbons, carboxamido, aldehydo, and sulfonamido. Fused refers to fused, bonded or attached. Preferred are alpha or beta aliphatic amino acids with primary, secondary or tertiary amino groups and ortho aromatic amino acids with primary, secondary or tertiary amino groups. Specific examples include glycine, alanine, valine, leucine, serine, threonine, isoleucine, 2-aminobutyric acid, 2-methylaminobutyric acid, 2-dimethylaminobutyric acid, N-phenylalanine, proline, tryptophan, isoserine, methionine, histidine, methylamino acetic acid, dimethylamino acetic add, anthranlic acid, N, N-dimethylanthranilic acid, 4-chloroanthranilic acid, and 2-amino-1-naphthoic acid.

Specific examples of charge control agents useful in the present invention include, but are not limited to hydroxy (3,5-di-tertiary-butyl salicylic-co-nonenoic) aluminate, hydroxy (3,5-di-tertiary-butyl salicylic-co-benzoic) aluminate, hydroxy (3,5-di-tertiary-butyl salicylic-co-2,5-dimethylbenzene sulfonic) aluminate, hydroxy (3,5-di-tertiary-butyl salicylic-co-p-toluic) aluminate, hydroxy (3,5-di-tertiary-butyl salicylic-co-2-furoic) aluminate, hydroxy (3,5-di-tertiary-butyl salicylic-co-p-toluene sulfonic) aluminate, hydroxy (3,5-di-tertiary-butyl salicylic-co-nicotinic) aluminate, hydroxy (3,5-di-tertiary-butyl salicylic-co-furylacrylic) aluminate, hydroxy (3,5-di-tertiary-butyl salicylic-co-2-phenoxybutyric) aluminate, hydroxy (3,5-di-tertiary-butyl salicylic-co-2-hydroxy-1-naphthoic) aluminate, hydroxy his (2-hydroxy-1-naphthoic) aluminate, hydroxy (glycine-co-3,5-di-tertiary-butyl salicylic) aluminate, hydroxy (glycine-co-p-toluene sulfonic) aluminate, hydroxy (alanine-co-nonenoic) aluminate, hydroxy (3,5-di-tertiary-butyl salicylic-co-anthranilic) aluminate and hydroxy (3,5-di-tertiary-butyl salicylic-co-N,N-dimethylanthranilic) aluminate.

Other specific examples and a further discussion of such aluminum salts of acid charge control agents are set forth in co-pending U.S. application No. 08/606,956 (D/95450) filed Feb. 23, 1996, recited herein.

Charge control agents are present in various effective amounts of, for example, from about 0.1 to about 15, and preferably from about 1 to about 4 weight percent.

Examples of liquid carders selected for the developers of the present invention include a liquid with an effective viscosity of from about 0.5 to about 500 centipoise, preferably from about 1 to about 20 centipoise, and a resistivity greater than or equal to $5\times10^9$ ohm/centimeters, such as $10^{13}$ ohm/cm or more. Preferably, the liquid selected in embodiments is a branched chain aliphatic hydrocarbon having preferably from about 12 to about 16 carbon atoms, or a mixture of straight chain hydrocarbons of from about 10 to about 16 carbons. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K is between about 177° C. and about 197° C. ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are known and should have an electrical volume resistivity in excess of $10^9$ ohm-centimeters and a dielectric constant below or equal to 3.0. Moreover, the vapor pressure at 25° C. should be less than or equal to 10 Torr in embodiments.

While the ISOPAR® series liquids are the preferred nonpolar liquids, in embodiments, for use as dispersants in the liquid developers of the present invention, the important characteristics of viscosity and resistivity can be achieved it is believed with other suitable liquids. Specifically, the NORPAR® series available from Exxon Corporation, the SOLTROL® series from the Phillips Petroleum Company, and the SHELLSOL® series from the Shell Oil Company can be selected.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably, 0.5 to 2.0 percent by weight.

Any suitable thermoplastic toner resin can be selected for the liquid developers of the present invention in effective amounts of, for example, in the range of 99 percent to 40 percent of developer solids, and preferably 95 percent to 70 percent of developer solids. Developer solids include the thermoplastic resin, optional pigment and charge control agent and any other component that comprises the particles. Examples of such resins include ethylene vinyl acetate (EVA) copolymers (ELVAX® resins, E. I. DuPont de Demours and Company, Wilmington, Del.); copolymers of ethylene and α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 Natural (Union Carbide Corporation); ethylene vinyl acetate resins, for example DQDA 6832 Natural 7 (Union Carbide Corporation); SURLY® ionomer resin (E. I. de Nemours and Company); or blends thereof; polyesters; polyvinyl toluene; polyamides; styrene/butadiene copolymers; epoxy resins; acrylic resins, such as copolymer of acrylic or methacrylic acid and at least one alkyl ester of acrylic or methacrylic acid wherein alkyl is from 1 to about 20 carbon atoms, like methyl methacrylate (50 to 90 percent), methacrylic acid (0 to 20 percent), ethylhexylacrylate (10 to 50 percent); and other acrylic resins including ELVACITE® acrylic resins (E. I. DuPont de Nemours and Company); or blends thereof. Preferred copolymers are the copolymer of ethylene and an α-β-ethylenically unsaturated acid of either acrylic acid or methacrylic acid.

In the present invention, it is preferred that more than one thermoplastic resin is used. When two thermoplastic resins are used, each thermoplastic resin is present in an amount of from about 20 to about 49.5, preferably from about 35 to about 45.5 percent by weight total solids. Preferably, the mixed thermoplastic resin comprises an ethylene vinyl acetate copolymer and an α-β-ethylenically unsaturated acid, such as in embodiments a methacrylic acid or an acrylic acid. The mixed resin may be selected from the group listed above. In preferred embodiments, the ethylene vinyl acetate copolymer resin is for example Elvax 205W, Elvax 200W, Elvax 210W, Elvax 500W, or the like, or AT Plastics 1880M, 2830M, 2850M, or the like. In embodiments, the preferred acrylic acid resin is methacrylic acid resin such as, for example, NUCREL® RX-76 (a copolymer of ethylene and methacrylic acid with a melt index at 190° C. of 800), NUCREL® 699, NUCREL® 960, NUCREL® 599 all from DuPont, or the like. The characteristics of preferred resins of the present invention are set forth below (VA refers to vinyl acetate and MA refers to methacrylic acid):

| | % VA/MA | Melt Index |
|---|---|---|
| Resin (Elvax) | | |
| 200W | 28VA | 2500 |
| 205W | 28 | 850 |
| 210W | 28 | 400 |
| 500W | 14 | 2500 |
| 2830M | 28 | 150 |
| 2850M | 28 | 850 |
| poly(ethylene-co-vinylacetate) | | |
| Resin (Nucrel) | | |
| RX-76 | 10MA | 800 |
| 599 | 10 | 400 |
| 699 | 11 | 100 |
| 960 | 15 | 60 |
| poly(ethylene-co-methaerylic acid) | | |

Use of a mixed resin may allow for the liquid developer to possess the benefits of the functionalities and the qualities of both resins. For examples, resins such as ethylene vinyl acetate resins possess a high melt index. In addition, high toner charging is a quality observed by methacrylic acid copolymer resins. A liquid developer with both ethylene vinyl acetate and methacrylic acid copolymer resins possesses both desired qualities of a high melt index and high toner charging. Therefore, the use of mixed resins may result in liquid developers having the desired qualities of the resins comprising the developers. Other advantages of the present process include the ability to incorporate a resin with chemical binding abilities, such as methacrylic acid containing resins. These resins can be used to bind charge control additives, while still being compatible with other resins that give other functional properties, such as high melt index.

The liquid developers of the present invention may optionally contain, and preferably do contain, a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on commercially available the total weight of solids contained in the developer. The amount of colorant used may vary depending on the use of the developer. Examples of colorants include commercially available pigments like carbon blacks, REGAL 330®, cyan, magenta, yellow, blue, green, brown and mixtures thereof; and pigments as illustrated in U.S. Pat. No. 5,223,368, the disclosure of which is totally incorporated herein by reference in its entirety, and more specifically, the following:

| PIGMENT BRAND NAME | MANUFACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YE; PW UT-858-D | Heubach | Yellow 74 |
| Hansa Yellow X | Hoechst | Yellow 75 |
| NOVAPERM ® YELLOW HR | Hoechst | Yellow 83 |
| L75-2337 | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTTAPERM ® YELLOW H4G | Hoechst | Yellow 151 |
| HOSTTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONSTRAL ® SCARLET | Ciba-Geigy | Red 207 |
| HELIOGEN ® BLUE L 6901f | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7201F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-191 | DuPont | White 6 |
| MOGUL ® L | Cabot | Black, C1 77266 |
| UHLICH ® bk 8200 | Paul Uhlich | Black |
| Rhodamine Y | Sun Chemicals | Magenta |
| PV Fast Blue | BASF | Cyan |

Suitable nonpolar liquid soluble ionic or zwitterionic charge director compounds which are selected in various effective amounts such as about 0.25 to 1,500 milligrams/gram, preferably 2.5 to 400 milligrams/gram based on the amount of developer solids comprised of resin, pigment, and charge adjuvant, include anioic glyceride, such as EMPHOS D70-30C TM and EMPHOS F27-85®, MSSN 505043, D/94028I, the disclosure of which is totally incorporated herein by reference, two products available from Witco Corporation, New York, N.Y.; sodium salts of phosphated mono and diglycerides with unsaturated and saturated acid substituents, respectively, lecithin, BASIC BARIUM PETKONATE®, NEUTRAL BARIUM PETRONATE®, CALCIUM PETRONATE®, NEUTRAL CALCIUM PETRONATE®, oil soluble petroleum, Witco Corporation, New York, N.Y., petroleum solfonate,; and metallic soaps such as bariurn, calcium, lead, and zinc stearates; cobalt, manganese, lead, and zinc linoleates, calcium and cobalt octoates; quaternary ammonium block copolymers as illustrated, for example, in U.S. Pat. No. 5,035,972, the disclosure of which is totally incorporated herein by reference, and the like.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is required for image development and background cleaning.

The toner particle mobility can be measured by well known techniques including Series Capacitance technique. The performance can be measured using FIST (Focused Ion Stream) ionographic print system. Measurements made by this technique have been shown to correlate with image quality, for example high mobilities can lead to improved image density, resolution and improved transfer efficiency. Residual conductivity, that is the conductivity from the continuous phase, can be measured using a low field device.

To increase the toner particle charge, and accordingly, to increase the mobility and transfer latitude of the toner particles, charge adjuvants can be added to the toner particles. For example, adjuvants, such as metallic soaps like aluminum or magnesium stearate or octoate, fine particle size oxides, such as oxides of silica, alumina, titania, and the like, paratoluene sulfonic acid, and polyphosphoric acid, may be added. Negative charge adjuvants increase the negative charge of the toner particles, while the positive charge adjuvants increase the positive charge of the toner particles. With the invention of the present application, these types of adjuvants can assist in enabling improved toner charging characteristics, namely, an increase in particle charge that results in improved electrophoretic mobility for improved image development and transfer to allow superior image quality with improved solid area coverage and resolution in embodiments. The adjuvants can be added to the toner particles in an amount of from about 0.1 percent to about 15 percent of the total developer solids and preferably from about 1 percent to about 5 percent of the total weight of solids contained in the developer.

The liquid electrostatic developer of the present invention is prepared, in embodiments, by a process involving reacting a first thermoplastic resin with a charge control agent, followed by reacting this reaction product with a second thermoplastic resin. More specifically, a nonpolar liquid, a first thermoplastic resin containing acidic residues, a charge control agent and colorant are added together and mixed in a manner that the resulting mixture contains, for example, about 15 to about 40 percent by weight of solids. This mixture is heated to a temperature sufficient to form a homogeneous plastic mass, which temperature may be from about 50° C. to about 120° C., preferably 90° C., until a uniform dispersion is formed. The mixing of the above ingredients at an elevated temperature is referred to as hot mixing or melt mixing and must continue until completion of the reaction of the resin and charge control agent. The time required for adequate mixing usually takes from about 30 minutes to 4 hours, preferably from about 1.5 to about 2 hours, and particularity preferred about 2 hours. Total throughput times may vary and are dictated by processing hardware, materials sets and processing parameters. This hot mixing is followed by addition of a second resin with heat (for example, from about 50° C. to about 80° C., preferably about 70° C.) for a time of from about 30 minutes to about 4 hours, preferably about 1 to about 2 hours, and particularly preferred about 1 hour. A second resin must be added after the first thermoplastic resin and the charge control agent have chemically reacted so as to covalently bond the charge control agent to the first resin. As an example, in the case of a preferred first resin, methacrylic acid copolymer resin, the charge control agent must react so as to covalently bond the methacrylic acid groups with the charge control agent. If both the first resin and the second resin are added simultaneously with the charge control agent, the reaction between the first resin and the second resin is incomplete. The solids content increases to from about 28 to about 40 percent solids.

Sufficient nonpolar liquid is added to provide a dispersion of from about 10 to about 50 percent solids. The resulting mixture of first resin covalently bonded to charge control agent and mixed with second resin and nonpolar liquid, is subjected to elevated temperatures during the initial mixing procedures to plasticize and soften the first and second resins. The mixture is sufficiently heated to provide a uniform dispersion of all solid materials, that is colorant, adjuvant and resins. However, the temperature at which this is undertaken should not be so high as to degrade the nonpolar liquid or decompose the resins or colorant when present. Accordingly, the mixture, in embodiments, is heated to a temperature of from about 70° C. to bout 130° C., and preferably from about 75° C. to about 100° C. The mixture may be ground in a heated ball mill or heated attritor at this temperature for about 15 minutes to 5 hours, and preferably from about 60 to about 180 minutes.

In carrying out the above process, a suitable mixing or blending vessel, for example, an attritor, heated ball mill, heated vibratory mill such as a Sweco Mill manufactured by Sweco Co., Los Angeles, Calif. equipped with particulate media, for dispersing and grinding, a Ross double planetary mixer manufactured by Charles Ross and Son, Hauppauge, N.Y., or a two roll heated mill, which requires no particulate media is used. Useful particulate media include materials like a spheres or cylinders of stainless steel, carbon steel, alumina, ceramic, zirconia, silica and sillimanite. A typical diameter range for the particulate media is in the range of from about 0.04 to about 0.5 inch (approximately 1.0 to approximately 13 millimeters).

The above processes are followed by adding an additional amount of nonpolar liquid sufficient to decrease the total solids concentration of the developer to from about 10 to about 25 percent by weight. A ionic or zwitterionic charge directing compound and optionally a charge adjuvent can be added prior to, concurrently with, or subsequent to the addition of the diluting dispersant hydrocarbon liquid.

Upon addition of the additional nonpolar liquid, the dispersion is cooled to a temperature of from about 10° to about 30 ° C. (a temperature suitable for formulation of a particulate phase), and the dispersion is cold ground for a time of from about 1 to about 6 hours, preferably 5 hours. Cooling may be accomplished in the same vessel, such as an attritor, while simultaneously grinding with particulate media to prevent formation of a gel or solid mass. Cooling is accomplished by means known to those skilled in the art and is not limited to cooling by circulating cold water, glycols such as ethylene glycol, or a cooling material through an external cooling jacket adjacent the dispersing apparatus or permitting the dispersion to cool to ambient temperature. While cooling, the grinding is continued with particulate media to prevent the formation of a gel or solid mass; without stirring to form a gel or solid mass, followed by shredding the gel or solid mass and grinding by means of particulate media; or with stirring to form a viscous mixture and grinding by means of particulate media. Additional liquid may be added at any time during the preparation of the liquid developer to facilitate grinding or to dilute the developer to the appropriate percent solids needed for developing. The resin containing phase precipitates out of the dispersant during the cooling.

As illustrated herein, the developers or inks of the present invention can be selected for imaging and printing methods wherein, for example, a latent image is formed on a photoconductive imaging member, reference for example selenium, selenium alloys, those of U.S. Pat. No. 4,265,990, the disclosure of which is totally incorporated herein by reference, and the like; followed by development with the toner of the present invention by, for example, immersion of the imaging member in the liquid toner; transfer to a suitable substrate like paper; and fixing by heating.

In the above discussion and below claims, developer solids includes thermoplastic resins, optional pigment, charge control agent and charge adjuvant. Unless otherwise specified, all amounts are percentage weights per weight of total developer solids, total developer solids including the total percentage by weight of thermoplastic resins, pigments, charge control agents, and charge adjuvant in the developer.

Specific embodiments of the invention will now be described in detail. These examples are intended to be illustrative, and the invention is not limited to the materials, conditions, or process parameters set forth in these embodiments. All parts are percentages by developer solid weight unless otherwise indicated.

EXAMPLES

Example 1

Comparative Example using One Step Hot Mix (Sample 27166-102-1)

A 1S attritor running at 100 rpm was charged with 370 g Isopar-M. The steam was turned on with a starting temperature of about 25° C. (steam and water allowed to flow through a jacket surrounding the attritor). When the temperature reached approximately 50° C., the attritor was charged with 84.0 g Nucrel® RX-76, 56.8 g Fanal Pink pigment, 2.27 g Alohas Charge Control Additive, and 84.0 g AT Plastics 2850M (or Elvax 205W). At 80° C., the steam was turned off and the mixing speed of the attritor was turned up to 150 rpm. The dispersion was mixed for about 2 hours.

After the second hour of hot melt mixing, cold water was turned on, the mixing speed was turned up to 200 rpm, and the attritor was charged with 980 g Isopar-G which was added to the mixture. The resulting mixture was cold ground under these conditions for 4.5 hours. Subsequently, the cold water was turned off and the contents of the attritor were discharged through a spiget at the bottom of attritor. Approximately 200 g of Isopar-G was used to rinse out the contents from the attritor.

Residual hydrocarbon was burned off using heat lamps (or an oven) in order to obtain a desired solids content of a small sample (12,178%). The toner was then formed into ink by diluting to 1.0 wt % solids in Isopar-G and adding 50 mg charge director per gram of toner solids. The samples were allowed to charge for about 2 days and then were pit tested in a Savin 870.

Example 2

Comparative Example using One Step Hot Mix (27166-102-3)

The same procedure as in Example 1 was followed except that Nucrel® 599 was added in place of Nucrel® RX-76.

Example 3

Two Step Hot Mix (Sample 27287-7-2)

A 1S attritor running at 100 rpm was charged with 370 g Isopar-M. The steam was turned on with a starting temperature of about 25° C. (steam and water allowed to flow through a jacket surrounding the attritor). When the temperature reached approximately 50° C., the attritor was charged with 84.0 g Nucrel® 599 and 56.8 g Fanal Pink pigment and 2.27 g Alohas Charge Control Additive. At 80° C., the steam was turned off and the mixing speed of the attritor was turned up to 150 rpm. The mixture was mixed under these conditions for about 1 hour, and then 84.0 g AT Plastics 2850M (or Elvax 205W) was added. At this point, the temperature was about 75° C. The steam was turned on again for a short period of about 1 minute for the purpose of raising the temperature to 80° C. The steam was then turned off and the entire mixture allowed to mix at 125 rpm for another hour (for a total of 2 hours for the hot melt step).

After the second hour of hot melt mixing, cold water was turned on, the mixing speed was turned up to 200 rpm, and the attritor was charged with 980 g Isopar-G which was added to the mixture. The resulting mixture was cold ground under these conditions for 4.5 hours. Subsequently, the cold water was turned off and the contents of the attritor were discharged through a spiget at the bottom of attritor. Approximately 200 g of Isopar-G was used to rinse out the contents from the attritor.

Residual hydrocarbon was burned off using heat lamps (or an oven) in order to obtain a desired solids content of a small sample (12.504%). The toner was then formed into ink by diluting to 1.0 wt % solids in Isopar-G and adding 50 mg charge director per gram of toner solids. The samples were allowed to charge for a couple days (about 2 days) and then were print tested.

| | |
|---|---|
| Toner | 119.96 g of 27287-2 (12.504% solids) |
| Charge Director | 15.0 g of 26948-7-2 (5.0 wt % 4K Hbr Quat) |
| Hydrocarbon | 1365.04 g of Isopar-G |

Example 4

Two Step Hot Mix (27287-7-1)

The same procedures as in Example 3 were followed except that 1.14 g of Alohas were added in place of 2.27 g.

Example 5

Two Step Hot Mix
(27287-7-3)

The same procedures as in Example 3 were followed except that Nucrel® RX-76 resin was used instead of Nucrel® 599, and 1.14 g of Alohas were added in place of 2.27 g.

The following results are for a 1500 g sample of 1.0 wt % solids charged at 50/1 (milligrams charge director per gram toner solids) with 4K Hbr Quat:

TABLE 1

| Sample Number | Components | Processing | Develop Results |
|---|---|---|---|
| 27166-102-1 | 37% EVA; 37% RX-76 1% Alohas | One Step Hot Mix | 50% (–) Toner 50% (+) Toner |
| 27166-102-3 | 37% EVA; 37% Nucrel 599 1% Alohas | One Step Hot Mix | 50% (–) Toner 50% (+) Toner |
| 27287-7-2 | 37% EVA; 37% Nucrel 599 1% Alohas | Two Step Hot Mix | 100% (–) Toner |
| 27287-7-1 | 37% EVA; 37% Nucrel 599 0.5% Alohas | Two Step Hot Mix | 100% (–) Toner |
| 27287-7-3 | 37% EVA; 37% RX-76 0.5% Alohas | Two Step Hot Mix | 100% (–) Toner |

From the results shown in the Table 1 above, it is clear that by mixing a first thermoplastic resin with a charge control agent, followed by mixing a second thermoplastic resin with the reaction product of the first resin and charge control agent, liquid developers with substantially 100% negative toner are prepared (Examples 3–5). The results demonstrate that the charge control agent bonded completely with the first resin. Conversely, mixing both the first and second thermoplastic resins together with the charge control agents results in a liquid developer having 50 percent positive toner and only 50 percent negative toner (Examples 1–2). It is clear that in the comparative examples, the charge control agent did not completely bind with the resin. Because a higher percentage negative toner results in a high melt index and smaller particles, the copy quality of a copy developed using toners prepared by the process herein is significantly increased.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. A process for the preparation of negatively charged liquid developers comprising a nonpolar liquid, a mixture of more than one thermoplastic resins, a charge director, and an aluminum charge control agent, wherein said process comprises melt mixing and reacting a first thermoplastic resin with said charge control agent, subsequently adding to the product obtained a second thermoplastic resin to prepare a mixture of the reaction product of said first thermoplastic resin withsaid charge control agent and said second thermoplastic resin, and subsequently dispersing said mixture and a charge director in nonpolar liquid to produce a negatively charged liquid developer.

2. A process in accordance with claim 1, wherein said first thermoplastic resin is a copolymer selected from the group consisting of acrylic acid copolymer and methacrylic acid copolymer.

3. A process in accordance with claim 2, wherein said first thermoplastic resin is a methacrylic acid copolymer.

4. A process in accordance with claim 1, wherein said second thermoplastic resin is an ethylene vinyl acetate.

5. A process in accordance with claim 2, wherein the methacrylic acid is selected from the group consisting of NUCREL® 599, NUCREL® 699, NUCREL® 960 and NUCREL® RX-76.

6. A process in accordance with claim 4, wherein the ethylene vinyl acetate resin is selected from the group consisting of Elvax®200W, Elvax®205W, Elvax®210W, Elvax®500W, AT Plastics 1880M, AT Plastic 2540M, AT Plastic 2830 and AT Plastic 2850M.

7. A process in accordance with claim 1, wherein the first thermoplastic resin is present in an amount of from about 35 to about 47.5 weight percent of total developer solids.

8. A process in accordance with claim 1, wherein the second thermoplastic resin is present in an mount of from about 35 to about 47.5 weight percent of total developer solids.

9. A process in accordance with claim 1, wherein the melt mixing is at a temperature of from about 50° C. to about 120° C.

10. A process in accordance with claim 9, wherein the melt mixing is for a time of from about 30 minutes to about 4 hours.

11. A process in accordance with claim 1, wherein after the addition of said second thermoplastic resin, the resulting mixture is heated at a temperature of from about 50° C. to about 80° C.

12. A process in accordance with claim 11, wherein the mixture is heated for a time of from about 30 minutes to about 4 hours.

13. A process in accordance with claim 11, wherein subsequent to addition of said second thermoplastic resin and heating the mixture, the resulting mixture is cooled to a temperature of from about 10° to about 30° C.

14. A process in accordance with claim 1, wherein said developer further comprises a pigment, colorant, or dye.

15. A process in accordance with claim 14, wherein said developer solids of first and second thermoplastic resins, aluminum charge control agent and pigment are 100 percent negatively charged.

16. A process in accordance with claim 1, wherein said charge control agent is an aluminum salt of an acid.

17. A process in accordance with claim 16, wherein said aluminum salt of an acid charge control agent is selected from the group consisting of hydroxy carboxylic acids, amino carboxylic acids, aromatic sulfonic acids, aliphatic carboxylic acids, and aromatic carboxylic acids.

18. A process in accordance with claim 1, wherein said charge control agent comprises a component of the following formulas (a) and (b):

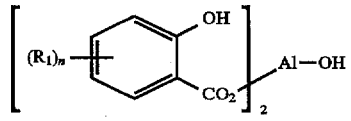

(a)

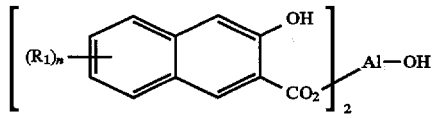

(b)

wherein $R_1$ is selected from the group consisting of hydrogen and alkyl, and n is a number 0 (zero), 1, 2, 3, or 4.

19. A process in accordance with claim 18, wherein $R_1$ is hydrogen or an alkyl having from about 1 to about 25 carbon atoms.

20. A process in accordance with claim 19, wherein $R_1$ is selected from the group consisting of hydrogen, isopropyl, n-butyl, isobutyl, and tert-butyl.

21. A process in accordance with claim 1, wherein said aluminum charge control agent is selected from the group consisting of hydroxy (3,5-di-tertiary-butyl salicylic-co-nonenoic) aluminate, hydroxy (3,5-di-tertiary-butyl salicylic-co-benzoic) aluminate, hydroxy (3,5-di-tertiary-butyl salicylic-co-2,5-dimethylbenzene sulfonic) aluminate, hydroxy (3,5-di-tertiary-butyl salicylic-co-p-toluic) aluminate, hydroxy (3,5-di-tertiary-butyl salicylic-co-2-furoic) aluminate, hydroxy (3,5-di-tertiary-butyl saiicylic-co-p-toluene sulfonic) aluminate, hydroxy (3,5-di-tertiary-butyl salicylic-co-nicotinic) aluminate, hydroxy (3,5-di-tertiary-butyl salicylic-co-furylacrylic) aluminate, hydroxy (3,5-di-tertiary-butyl saiicylic-co-2-phenoxybutyric) aluminate, hydroxy (3,5-di-tertiary-butyl salicylic-co-2-hydroxy-1-naphthoic) aluminate, hydroxy his (2-hydroxy-1-naphthoic) aluminate, hydroxy (glycine-co-3,5-di-tertiary-butyl salicylic) aluminate, hydroxy (glycine-co-p-toluene sulfonic) aluminate, hydroxy (alanine-co-nonenoic) aluminate, hydroxy (3,5-di-tertiary-butyl salicylic-co-anthranilic) aluminate, hydroxy (3,5-di-tertiary-butyl salicylic-co-N,N-dimethylanthranilic) aluminate, hydroxy bis(3,5-di-tert-butyl salicylic) aluminate, hydroxy bis(3,5-di-tert-butyl salicylic) aliminate monohydrate, hydroxy bis (3,5-di-tert-butyl salicylic) aluminate dihydrate, hydroxy bis(3,5-di-tert-butyl salicylic) aluminate trihydrate, hydroxy bis(3,5-di-tert-butyl salicylic) aluminate tetrahydrate, aluminum di-tertiary-butyl salicylate, hydroxy bis(salicylic) aluminate, hydroxy bis(monoalkyl salicylic) aluminate, hydroxy bis(dialkyl salicylic) aluminate, hydroxy bis (trialkyl salicylic) aluminate, hydroxy bis(tetraalkyl salicylic) aluminate, hydroxy bis(hydroxy naphthoic acid) aluminate, hydroxy bis(monoalkylated hydroxy naphthoic acid) aluminate, bis(dialkylated hydroxy naphthoic acid) aluminate, bis(trialkylated hydroxy naphthoic acid) aluminate, and bis(tetraalkylated hydroxy naphthoic acid) aluminate.

22. A process in accordance with claim 1, wherein said charge control agent is present in an amount of from about 0.1 to about 15 percent by weight based on the total weight of developer solids.

23. A process in accordance with claim 14, wherein said developer further comprises a pigment.

24. A process in accordance with claim 23, wherein said pigment is carbon black, magenta, yellow, cyan, or mixtures thereof.

25. A process in accordance with claim 23, wherein said pigment is present in an amount of from about 5 to about 60 percent by weight based on the total weight of the developer solids.

26. A process in accordance with claim 1, wherein said nonpolar liquid is selected from the group consisting of a) an aliphatic hydrocarbon comprising a mixture of branched hydrocarbons of from about 12 to about 16 carbons, and b) a mixture of straight chain hydrocarbons of from about 10 to about 16 carbons.

27. A process in accordance with claim 1, wherein said charge director is selected from the group consisting of an oil-soluble petroleum sulfonate, lecithin, and a quaternary ammonium block copolymer.

28. A process for the preparation of liquid developers comprised of a nonpolar liquid, a mixture of thermoplastic resin particles, a charge director, and an aluminum charge control agent comprised of a component of the alternative formulas (a) or (b):

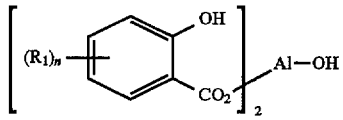

(a)

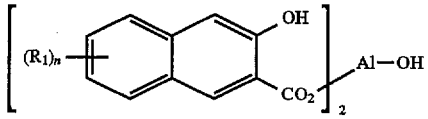

(b)

wherein $R_1$ is selected from the group consisting of hydrogen and alkyl, and n is a number 0 (zero), 1, 2, 3, or 4, wherein said process comprises melt mixing and reacting a first thermoplastic resin selected from the group consisting of a methacylic acid copolymer and an acrylic acid copolymer with said aluminum charge control agent, subsequently adding to a product obtained an ethylene vinyl acetate as a second thermoplastic resin to prepare a mixutre of the reaction product of said first thermoplastic resin with said charge control agent and said second thermoplastic resin, and subsequently dispersing said mixture and a charge director in nonpolar liquid to produce a negatively charged liquid developer.

29. A process for the preparation of liquid developers comprised of a nonpolar liquid, a mixture of thermoplastic resin particles, a charge director, and an aluminum charge control agent selected from the group consisting of aluminum salts of hydroxy carboxylic acids, aluminum salts of amino carboxylic acids, aluminum salts of aromatic sulfonic acids, aluminum salts of aliphatic carboxylic acids, aluminum salts of aromatic carboxylic acids, and mixtures thereof, wherein said process comprises melt mixing and reacting a first thermoplastic resin selected from the group consisting of a methacylic acid copolymer and an acrylic acid copolymer with said aluminum charge control agent, subsequently adding to a product obtained an ethylene vinyl acetate as a second thermoplastic resin to prepare a mixture of the reaction product of said first thermoplastic resin with said charge control agent and said second thermoplastic resin, and subsequently dispersing said mixture and a charge director in nonpolar liquid to produce a negatively charged liquid developer.

30. A liquid developer comprising the product of claim 1.

* * * * *